US010995464B2

(12) United States Patent
Van Loon et al.

(10) Patent No.: US 10,995,464 B2
(45) Date of Patent: May 4, 2021

(54) JACK-UP PLATFORM COMPRISING A MOORING SYSTEM AND METHOD FOR MOORING A FLOATING VESSEL

(71) Applicant: DEME Offshore BE N.V., Zwijndrecht (BE)

(72) Inventors: Jeroen Van Loon, Turnhout (BE); Dieter Wim Jan Rabaut, Ghent (BE)

(73) Assignee: DEME Offshore BE N.V., Zwijndrecht (BE)

( * ) Notice: Subject to any disclaimer, the term of this patent is extended or adjusted under 35 U.S.C. 154(b) by 0 days.

(21) Appl. No.: 16/515,942

(22) Filed: Jul. 18, 2019

(65) Prior Publication Data

US 2021/0017727 A1 Jan. 21, 2021

(51) Int. Cl.

| | |
|---|---|
| ***E02B 17/02*** | (2006.01) |
| ***E02B 17/08*** | (2006.01) |
| ***B63C 5/02*** | (2006.01) |
| ***B63B 21/50*** | (2006.01) |

(Continued)

(52) U.S. Cl.

CPC ..... *E02B 17/021* (2013.01); *B63B 21/50* (2013.01); *B63C 5/02* (2013.01); *E02B 17/02* (2013.01); *E02B 17/089* (2013.01); *E02B 17/0836* (2013.01); *E02D 27/52* (2013.01);

(Continued)

(58) Field of Classification Search

CPC .. E02B 17/021; E02B 3/26; E02B 2017/0056; E02B 2017/0091; E02B 17/003; E02B 17/08; B63B 21/50

See application file for complete search history.

(56) References Cited

U.S. PATENT DOCUMENTS 2,420,677 A * 5/1947 Peterson ..... E02B 3/28 405/212
2,915,879 A * 12/1959 Besse ..... E02B 3/26 405/212

(Continued)

FOREIGN PATENT DOCUMENTS

GB 2065198 A 6/1981
WO WO 2019170833 * 9/2019

OTHER PUBLICATIONS

International Search Report for corresponding international application PCT/EP2020/070352 dated Nov. 12, 2020.

*Primary Examiner* — Carib A Oquendo

(74) *Attorney, Agent, or Firm* — Renner, Otto, Boisselle & Sklar, LLP

(57) ABSTRACT

A jack-up platform is described having a horizontal working deck that may be jacked up out of the water by moving its legs to a position wherein they take support on an underwater bottom. The jack-up platform further comprises a mooring system for mooring a floating vessel at a mooring side of the jack-up platform. The mooring system comprises an elongated support means for supporting a hull part of the floating vessel, and guiding means connected to the hull of the jack-up platform at the mooring side. The guiding means are able to rigidly hold the elongated support means in a support position, in which the elongated support means is within reach of the hull part of the floating vessel to be supported when the hull is jacked out of the water and the jack-up platform rests on its legs. A method for mooring a floating vessel using the jack-up platform is also described.

17 Claims, 14 Drawing Sheets

(51) Int. Cl.
*E02D 27/52* (2006.01)
*E02B 17/00* (2006.01)

(52) U.S. Cl.
CPC ..... *E02B 2017/0056* (2013.01); *E02B 2017/0091* (2013.01)

(56) References Cited

U.S. PATENT DOCUMENTS

| | | | | | |
|---|---|---|---|---|---|
| 3,373,713 | A * | 3/1968 | Hindman | E02B 17/003 | 114/220 |
| 3,516,259 | A * | 6/1970 | Tokola | E02B 17/003 | 405/208 |
| 3,593,529 | A * | 7/1971 | Smulders | E02B 17/021 | 405/209 |
| 3,695,209 | A * | 10/1972 | Giese | E02B 3/24 | 114/230.24 |
| 4,135,467 | A * | 1/1979 | Loire | E02B 3/26 | 114/219 |
| 4,480,944 | A | 11/1984 | Phares | | |
| 4,817,552 | A * | 4/1989 | Poldervaart | B63B 21/00 | 114/230.27 |
| 5,927,903 | A * | 7/1999 | Playter | E02B 3/26 | 405/212 |
| 6,851,892 | B2 * | 2/2005 | Alghamdi | E02B 3/26 | 405/211 |
| 2006/0051164 | A1 * | 3/2006 | Foo | E02B 17/0021 | 405/228 |
| 2009/0100614 | A1 * | 4/2009 | Dale | B63B 27/14 | 14/71.3 |
| 2010/0293781 | A1 * | 11/2010 | Foo | B66C 23/52 | 29/791 |
| 2014/0251493 | A1 | 9/2014 | Foo | | |

* cited by examiner

JACK-UP PLATFORM COMPRISING A MOORING SYSTEM AND METHOD FOR MOORING A FLOATING VESSEL

TECHNICAL FIELD OF THE INVENTION

The invention relates to a jack-up platform comprising a mooring system and to a method for mooring a floating vessel against the jack-up platform. The invention further relates to an assembly of a jack-up platform and a floating vessel, moored against each other with the mooring system.

BACKGROUND OF THE INVENTION

The invention is particularly relevant in the context of lifting objects between a floating vessel and a jack-up platform, by using a lifting device positioned on the jack-up platform. The lifting may be carried out in waters on-shore or off-shore, the latter being preferred. The jack-up platform may be floating, may be in a semi-jacked-up position, in which its hull is still in the water, or may be jacked-up with its hull fully out of the water. The jack-up platform in the latter case represents a relatively stable position for the lifting device. The jack-up platform may be self-propelling in which case it is generally referred to as a jack-up vessel. It is expressly stated that when a jack-up platform is referred to throughout the present disclosure, reference is also made to a jack-up vessel.

The invention is not limited to the lifting of particular objects, but may be used with advantage for lifting turbine components, such as a full tower of for instance 900 tons, a split tower (two sections) of 500 tons each for instance, a split tower (three sections) of 350 tons each for instance, a nacelle (+ rotor) of 800 tons for instance, blades (or a blade rack carrying a single blade, or a complete blade rack carrying multiple blades), and a pre-assembled combination of the above in any form. It is also possible to use the invention for lifting wind turbine foundation components, such as a monopile of 1600 tons for instance, a transition piece of 500 tons for instance, an anode cage (or anode cage tower containing multiple anode cages), and complete jackets, weighing up to 1600 tons and more. Apart from the above named objects, general items may also be lifted with the lifting device when using the invented mooring system. Such general items include but are not limited to supply containers of any kind, offshore wind turbine (foundation) installation equipment, and spare vessel and equipment parts.

The reference to the above wind turbine components does not imply that the invention is limited thereto, and the jack-up platform and method could be applied for lifting any other object, such as for instance, but not limited to, offshore foundation structures, jetties, radar and other towers, and the like.

A floating vessel in a water mass is subject to movements according to six degrees of freedom. Translational movements comprise heave, sway and surge. Where heave is a vertical movement, sway is the side to side or port to starboard movement and surge is the front to back or bow to stern movement. Rotational movements comprise pitch, roll and yaw. Where pitch is a rotation of a vessel about its lateral (port-starboard) axis, roll is the rotation about its longitudinal (bow-stern) axis, and yaw is the rotation about its vertical axis. Heave, sway, surge, pitch, roll and yaw movements are defined in a coordinate system fixed to the floating vessel and therefore may differ from movements in the vertical and two horizontal directions, defined by a coordinate system fixed to the outside world.

The motions of the water mass are transferred to a vessel that is floating on the water mass. The induced vessel movements, in turn, impose movements and accelerations on objects that are transported by the vessel or manipulated on or from the vessel. When lifting an object from a deck of a floating vessel with a lifting device for instance, the relative position between the floating vessel, including the object to be lifted off, and the lifting device preferably should be kept fixed within certain horizontal distance limitations that are defined by the lifting device's specifications. The object preferably should be kept positioned within a watch circle of the lifting device to avoid lifting the object under an angle with the vertical direction that is too large for the lifting device to handle. Preferably, a hoisting wire of the lifting device is kept substantially vertical during the lifting operations. This is especially the case when the lifting device is not provided on the floating vessel itself, but is provided on another floating vessel and/or on a stabilized vessel or platform, such as a jack-up platform that is separate from the object's vessel.

When lifting off an object from the floating vessel with a lifting device located on a jack-up platform, it is of importance that the horizontal position (⅔ translational degrees of freedom: surge & sway) and the horizontal rotational movement (⅓ rotational degrees of freedom: yaw) of the floating vessel, and therefore also of the objects it carries, remain fixed within certain limitations relative to the location of the lifting device, in order to avoid lifting device breakdown for instance during the lift, and to ensure a safe rigging procedure. The floating vessel preferably should have a fixed position versus the jack-up platform and the lifting device, provided thereon. Also, the jack-up platform and the lifting device preferably have to remain in a fixed horizontal position relative to an outside world reference system during lifting. Further, when using a lifting device provided on a semi-jacked-up or jacked-up jack-up platform, this lifting device will also be fixed horizontally relative to an outside world reference system during lifting. If both the floating vessel and lifting device are fixed horizontally to the same outside world reference system, their relative horizontal position will be also fixed towards each other. Further and ideally, the object to be lifted should preferably be positioned directly under the lifting device's connection point in a vertical direction. This is particularly challenging when lifting an object from a floating vessel carried out with a lifting device provided on a fixedly positioned jack-up vessel or platform in offshore conditions.

Known methods and systems for keeping a floating vessel positioned offshore next to a jack-up vessel comprise anchoring system in the first place. The floating vessel may then be equipped with an anchor spread. Usually an assist vessel (anchor handler) needs to be used in parallel, which is costly. Also, positioning a floating vessel on anchors is time consuming. The assist vessel picks up the anchors from the floating vessel and positions these at the correct location on the seabed. Having a couple of anchors lines out in different directions will keep the floating vessel or barge positioned in a more or less stable position. Anchoring systems are not ideal when used in combination with a jack-up vessel or platform, in particular when it is the intention to position the floating vessel as close as possible to the jack-up vessel. Depending on the size of the jack-up vessel and the floating vessel, as well as on the relative position of both, anchor lines could clash with the legs of the jack-up vessel, which represents a large risk. If an anchor line breaks, the floating vessel's position can become uncontrollable and a clash may even occur between the floating vessel itself and the legs of the jack-up vessel or platform when the lifting is performed when the jack-up vessel or platform is jacked-up until a height where the floating vessel fits under the jack-up vessel or platform. Such clashing indeed may immediately compromise the integrity of the jack-up vessel or platform. Also, anchors are typically fixated in the seabed, which may cause interfacing with existing (buried) structures in the seabed, for instance, but not limited to cables, pipelines, other debris and such like. Preliminary surveys are needed.

Another known method and system employs a floating vessel equipped with a dynamic positioning (DP) system, which also requires a certain amount of thrusters capable of holding the floating vessel in a fixed position. The more power the DP system possesses, the more accurate it can keep a certain position up to a designed sea state. More power will however come with greater cost. The accuracy of positioning when lifting an object off a floating vessel using a lifting device fixed on a static jack-up platform further should preferably be high, which requires thrusters with a high power. Using a floating vessel equipped with a DP system in close proximity with another structure (for instance the elevated jack-up platform, an offshore foundation or other) may also involve risks. A DP system's power is continuously adjusting to cope with external forces (water, wind, other, . . . ). As the system is working close to a structure, its own thruster force may induce forces that come into contact with the fixed structure and are reflected from it. This could cause the DP system to assume that the structure is applying a direct force onto the floating vessel (even if a physical connection between the floating vessel and the jack-up vessel has not been made). As a reaction, the DP system could try to react against this 'fake' external force by activating more power in the direction of the structure. This could cause the DP system to actually move the floating vessel towards the structure, cause it to collide with the structure. This of course is highly undesirable.

Although the known systems may be used in some circumstances, they generally have disadvantages, as stated above. The capacity of the lifting device on the jack-up platform may not be fully utilised since the floating vessel should in the known methods always leave some distance to (the legs of) the jack-up platform. Indeed, when the floating vessel would approach the (main legs of the) jack-up platform too closely, it could for instance partly slide under the jacked-up jack-up platform, hit the main legs and endanger the total stability of the jack-up platform.

SUMMARY OF THE INVENTION

It is an aim of the invention therefore to provide an adapted jack-up platform and method that makes it feasible to safely lift an object offshore from a deck of a floating vessel directly side-by-side to the jack-up vessel in a jacked-up position.

Provided for this and other purposes is a jack-up platform in accordance with claim 1. A jack-up platform is provided comprising a hull, a horizontal working deck and a number of vertical legs that connect to the working deck through a jacking system, each jack of the jacking system being configured to move a leg between a lower position, in which the leg takes support on an underwater bottom and the hull of the jack-up platform is jacked out of the water, and a higher position, in which the leg is free from the underwater bottom and the hull of the jack-up platform is floating on the water, wherein the jack-up platform further comprises a mooring system configured to moor a floating vessel at a mooring side of the jack-up platform, the mooring system comprising an elongated support means for supporting a hull part of the floating vessel, and guiding means connected to the hull of the jack-up platform at the mooring side, and configured to rigidly hold the elongated support means in a support position, in which the elongated support means is within reach of the hull part of the floating vessel to be supported when the hull of the jack-up platform is jacked (partly) out of the water and the jack-up platform rests on its legs.

The elongated support means of the mooring system may be embodied in many shapes. It may be shaped as a wall, or it may be shaped otherwise. A practical embodiment of the elongated support structure comprises a leg, optionally of similar construction as the legs of the jack-up platform. The elongated support means may comprise a full steel structure of any cross-sectional shape, or may comprise a lattice structure of any cross-sectional shape, for instance having a triangular or square cross-section. The support structures are elongated in the sense that they are configured to be provided in the water mass over a distance that may cover a substantial water depth, such as more than 50% of the water depth at the offshore mooring location, more preferably more than 60%, more preferably more than 70%, even more preferably more than 80%, or more than 90%, and even more preferably up to 100% of the water depth, being the distance from the water line to the sea bed. In a mooring position of a floating vessel, said floating vessel will be able to contact the elongated support structure. In another embodiment of the invention, the elongated supports may be pushed or provided otherwise into the soil. In such an embodiment, the support structures may even be longer than 100% of the water depth.

The guiding means are connected to the jack-up platform. They may for instance be welded to a side of the hull of the jack-up platform, or they may be connected to a part of the jack-up platform in any other suitable way. Alternatively, the guiding means may be placed horizontally on the working deck, and be hingedly connected to the jack-up platform at an edge thereof. In operation, the guiding means may then be deployed overboard to the side of the jack-up platform, for instance by hydraulic or other power or by a lifting device provided on the jack-up vessel, which may be the same lifting device as used for lifting the object off the deck of the floating vessel.

The guiding means may be embodiment in many different ways, as long as they are configured to hold the elongated support means in a support position, in which the elongated support means is within reach of the hull part of the floating vessel to be supported when the hull is jacked out of the water and the jack-up platform rests on its legs. Suitable embodiments of the guiding means comprise circumferential bodies into which an elongated support structure may be guided or slid, a ladder system onto which an elongated support structure may be guided or slid, a pile-shaped body over which an elongated support structure may be guided or slid, and the like. One skilled in the art will be able to design several embodiments of such guiding means without any difficulty.

The invention enables a floating vessel to be stabilized, at least in a horizontal plane, relative to the jack-up platform for instance in jacked-up position, which carries a lifting device for lifting an object from the floating vessel. When the jack-up vessel is preloaded and jacked-up to a certain working height above the waterline, a direct mooring of a floating vessel for instance a barge against the jack-up vessel would be nearly impossible. As the height of the hull of the jack-up platform is partly or completely raised out of the water and the floating body, of which the hull is partly submerged and partly above the water line, both hulls cannot be directly connected to each other using fenders in between. The jack-up platform comprising the invented mooring system solves this problem.

Known ways of positioning a floating vessel next to a jack-up vessel are all based on having the main position-keeping systems on board of the floating vessel itself. This has the drawback that one should always find a floating vessel having one of these systems installed, or one should invest in outfitting a floating vessel with one of such position-keeping systems. In offshore operations, selecting the correct sized floating vessel for the purpose is important, for cost reasons. Using floating vessels that are outfitted with a position-keeping system but are of inappropriate size is not advised. The jack-up platform of the present invention may be used in conjunction with substantially any floating vessel of any appropriate size. Using this system allows a large range of floating vessels to be positioned offshore next to a jack-up vessel without any further investments on the floating vessels. This safeguards the ability to find a suitable sized floating vessel, which could be different for each activity, project and still keep the project cost-efficient. The jack-up platform further allows for a relatively close positioning (even touching) of the floating vessel with the jack-up platform, whereas typical anchor systems and a DP system require more space in between both vessels for safety reasons. Having both vessels directly moored together and relatively close to each other means that the lifting device capacity of the jack-up vessel can be deployed more efficiently as well.

The invented mooring system on the jack-up platform enables limiting movements of the floating vessel in a horizontal plane relative to the fixedly positioned jack-up platform, and therefore also to the lifting device (and hook), provided on the jack-up vessel or platform. Yaw, surge and sway movements are not completely limited by the invention, but are mitigated sufficiently for offshore lifting, transfer of objects and components, and other purposes. During a lifting operation, it would be preferred to also compensate for heave movements to avoid a re-hit of the object with the floating vessel in a first phase of lifting. Such heave compensation may be provided by other systems, known per se. Further, roll and pitch movements may also create potential problems when lifting off components from a floating body with a fixed lifting device. These motions may for instance initiate swinging motions of the lifted objects as these rotational movements will create a certain angle of the floating vessel, and therefore also of its carried objects, relative to an absolute horizontal plane. Lifting off the objects whilst the floating body and said objects are provided under a certain angle with respect to the horizontal plane, may cause initial swinging motions of the objects after lift-off. These motions may for instance be avoided by using a motion compensated platform or sea fastenings underneath the objects to be lifted. It is also possible to control and dampen these movements out by using tagline systems.

It should be noted that the jack-up vessel or platform in combination with the mooring system according to the invention is able to mitigate a part of the roll, pitch and possibly heave motions as well, however not completely, and other systems such as the ones described above may have to be used in conjunction with the invented mooring system.

The invention has been created to safely position a floating vessel in a water mass next to a jacked-up jack-up vessel, mitigating surge, sway, and yaw movements to a large extend and partly mitigating roll and pitch movements, without bringing the integrity of the jack-up vessel in danger. More specifically, the present invention may be used to safely lift objects from a floating vessel without having a side-off-lead angle that is too large for the lifting device to handle.

An embodiment of the invention provides a jack-up platform further comprising a lifting device configured to lift the elongated support means from a resting position on the working deck and provide the elongated support means to the guiding means and into its support position. The lifting device may differ from, or be the same as, the lifting device configured to lift an object from the floating vessel. This embodiment allows transporting the elongated support means in a disassembled state from the guiding means, for instance in storage means provided on the working deck and separate from the guiding means. In this embodiment, the lifting device on the jack-up platform may be used to lower or raise the elongated support structure into the guiding means and temporarily hold its position at a certain needed vertical position (level) before a locking mechanism of the guiding means is activated automatically or manually, where after the elongated support structure could be released from the lifting device.

In another embodiment, a jack-up platform is provided wherein the guiding means are hingedly connected to the hull of the jack-up platform, and the jack-up platform further comprises a lifting device configured to up-end the elongated support means from a resting position on the working deck around the guiding means and into its support position.

In another embodiment, the elongated support means may be pre-installed in the guiding means, which guiding means may already be connected to the side of the hull, for instance hingedly around a hinge point, such that they may be stored horizontally on deck during transport. In the latter embodiment, the guiding means and the elongated support means are preferably deployed overboard simultaneously. This embodiment differs form another embodiment wherein, regardless of the way the guiding means are made, the elongated support means may always be stored horizontally on deck as well, for instance during transport, and be inserted into the guiding means before using the system.

Yet another embodiment provides a jack-up platform wherein the guiding means hold the elongated support means. In such an embodiment, the elongated support means are held by the guiding means, also during transport. This allows a faster deployment of the elongated support means at the offshore location of mooring.

The mooring system may accommodate floating vessels of different sizes. An embodiment which is particularly advantageous in this respect provides a jack-up platform wherein the guiding means are configured to hold the elongated support means and move the same between different vertical positions, preferably by comprising jacks. The guiding means are configured in this embodiment to guide the elongated support structure during its movement between different vertical positions, and to lock the elongated support structure in each desirable vertical position. A mechanical, hydraulic, or electric system, or a combination of such systems or other, could be incorporated in the guiding means to enable the (automatic) lowering, hoisting, and/or locking of the elongated support means at the different vertical (or height) positions.

According to the invention, the elongated support means is held in a support position, in which the elongated support means is within reach of the hull part of the floating vessel to be supported when the hull is jacked out of the water and the jack-up platform rests on its legs. The length of the elongated support means, such as legs in an embodiment, preferably is selected such that a minimum length of the elongated support means is able to cover the length between the top of the guiding means and a bottom of the floating vessel's hull, including the needed working height of the working deck of the jack-up vessel above the water level (the airgap) and taking into account the changing tide. In this way contact between the elongated support means and the floating vessel is always guaranteed over the complete depth of the hull of the floating vessel. More preferably, an additional safety length may be taken into account. This further reduces the risk of the floating vessel sliding under the elongated support means.

Another useful embodiment of the invention provides a jack-up platform wherein the elongated support means, in the support position, takes support on or in the underwater bottom. In this embodiment, the elongated support means are as long, or may be longer than the length of the legs of the jack-up platform. Similar to the legs of the jack-up platform, a lower part of the elongated support means may be pinned into the seabed, so that parts of the horizontal loads, acting from the floating vessel onto the jack-up vessel, are transmitted directly into the seabed and only another part of these loads will be transmitted into the jack-up vessel itself. In this embodiment, less horizontal forces are absorbed through the jacking system (the jacks) of the jack-up platform, which jacket system is mainly designed to cope with vertical forces instead of horizontal forces. This embodiment may be engineered in detail, based on a site specific assessment, because the soil properties of the sea bed or other water floor, may differ on each offshore location. The horizontal forces that the jack-up platform may be able to absorb, may depend on the jacking capabilities and therefore on soil properties. On each different location the contribution and capabilities of the forces going directly into the seabed through the elongated support means are generally soil dependent and unpredictable, so should be engineered for each location separately. An embodiment wherein part of the forces are redirected directly into the soil of the seabed through the elongated support system is beneficial to the invention since horizontal forces acting on the jacking system of the jack-up vessel are reduced as much as possible.

Another useful embodiment of the invention provides a jack-up platform wherein a vertical leg of the jack-up platform comprises a transversely enlarged foot support and an elongated support means, in the support position, takes support on or in the transversely enlarged foot support. A transversely enlarged foot support is also referred to in the art as a footing, shoe or spud can. Instead of pinning the elongated support means into the soil of the seabed, the elongated support means in this embodiment are connected, optionally as well, to the spud cans or shoes of the legs of the jack-up vessel. These shoes or spud cans are located at a bottom side of the jack-up platform's legs. In this embodiment, part of the horizontally induced loads in the elongated support means may be transmitted directly to the bottom part of the jack-up platform's legs, which comprises the spud cans or shoes that are fixed onto or into the soil of the seabed. The part of the horizontal loads transmitted through the jack-up vessel's hull and the actual jacking system, and the part that is redirected directly through the elongated support means into the footings of the jack-up vessel may be calculated on the basis of knowledge of the length of the elongated support means extending below the hull of the jack-up vessel, and of the relative connection height of the floating vessel. This embodiment reduces the horizontal forces that are absorbed by the jacking system of the jack-up vessel, and further is independent on uncertainty related to soil conditions of the seabed.

Another embodiment provides a jack-up platform that further comprises a connecting structure configured to connect an elongated support means with a vertical leg of the jack-up platform, while allowing the elongated support means to be moved between different vertical positions. This embodiment allows to transferring some of the horizontal forces experienced by the elongated support means to the legs of the jack-up platform.

Although the elongated support means of the invented mooring system may in embodiments extend under a non-zero angle with the vertical direction, a useful embodiment of the invention provides a jack-up platform wherein the elongated support means extends vertically in the support position.

Resulting from the definition of a jack-up vessel or platform, the only part of the jack-up platform in jacked-up state that is situated on the same vertical level as the floating vessel comprise the legs of the jack-up vessel that indeed connect the elevated hull structure of the jack-up platform with the sea floor. It could be conceivable that a floating vessel could be tied up directly to the jack-up platform legs. However, these legs are designed to mainly cope with vertical forces and less with horizontal forces that may be induced by the moored floating vessel. An impact of a floating vessel against the jack-up platform legs could be catastrophic for the stability of the jack-up platform. Also, due to the more inward position of these legs relative to the working deck of the jack-up platform and the side of the hull thereof, tying up the floating vessel directly to the jack-up platform's legs may imply that the hull of the floating vessel will be positioned partly underneath the hull of the jack-up vessel or platform. In this way, valuable deck space on the floating vessel is lost. An embodiment of the invention provides a jack-up platform wherein the guiding means comprise a vertical leg of the jack-up platform, preferably two legs of the jack-up platform located at the mooring side. The elongated support means provides the desired space between the jack-up platform's and the floating vessel's hull and its legs, yet this embodiment may in some cases provide a useful and cost-effective solution to the problem. The elongated support means in this embodiment may be provided between two legs of the jack-up platform and be guided by these two legs. In another embodiment, each leg guides one elongated support means.

The number of elongated support means may be chosen according to the requirements of the circumstances at the offshore location. An embodiment of the jack-up platform wherein the number of elongated support means is at least two, and preferably at least three, s preferred. The plurality of the elongated support means may be provided along a line that optionally extends parallel to the mooring side of the hull of the jack-up platform.

Another aspect of the invention relates to an assembly of a jack-up platform comprising the invented mooring system and a floating vessel, moored against it with the mooring system.

As already mentioned above, a vessel when floating on water is subjected to movements exhibiting 6 degrees of freedom, including three translational movements and three rotational movements. In a Cartesian coordinate system linked to a vessel, and defining the z-axis as extending vertically, the x-axis as extending in a longitudinal direction of the vessel and the y-axis as extending in a transverse direction of the vessel, an x-axis translational movement is referred to in the art as surge, a y-axis translational movement as sway, and a z-axis translational movement as heave. A rotational movement of the vessel around the x-axis is referred to as roll, a rotation around the y-axis as pitch, and a rotation of the vessel around the z-axis as yaw. Notably, the (x,y)-plane formed by the deck of the vessel may not be parallel to a plane extending parallel to the underwater bottom, due precisely to the vessel's motion on the water. The invented mooring system particularly operates in limiting movements of a moored vessel in the (x,y)-plane. Movements in the heave or z-direction of the moored vessel are less influenced by the invented mooring system. Indeed, the hull of the moored vessel is able to slide relatively unhindered against the elongated support means in a heave direction, apart from the friction generated by parts of the mooring system such as fenders.

The actual connection between the floating vessel or barge and the elongated support means may be embodied by using conventional mooring lines and winches. These winches could be placed either on the floating vessel, on the jack-up vessel or be integrated in one or more of the elongated support means. To prevent peak loads on the elongated support means, a shock damper may be incorporated in between the elongated support means and the floating vessel, such as but not limited to fenders, for instance standard practice Yokohama fenders.

Another aspect of the invention indeed relates to a method for mooring a floating vessel at a mooring side of a jack-up platform provided with the invented mooring system, the method comprising the steps of:

- moving the legs of the jack-up platform from a higher position, in which the legs are free from an underwater bottom and the hull is floating on the water, to a lower position, in which the legs take support on the underwater bottom and the hull is jacked out of the water;
- providing elongated support means for supporting a hull part of the floating vessel in a support position within reach of the hull part of the floating vessel to be supported by guiding means connected to the hull of the jack-up platform at the mooring side;
- rigidly holding the elongated support means in the support position by the guiding means; and
- mooring the floating vessel against the elongated support means.

A purpose of the invention is to assist in lifting an object from the moored floating vessel that itself may lack a lifting device suitable for lifting the object, by employing a lifting device provided on another platform or vessel, against which the floating vessel is moored. After having lifted the object off the floating vessel, the object may be placed directly onto or into an underwater bottom. It may however also be placed on deck of the floating vessel itself, the vessel or platform holding the lifting device, or it may be placed on deck of yet another supporting platform within lifting device reach, which may be the deck of another floating or jack-up vessel or platform. Another possibility is to place the object on top of a pre-installed wind turbine generator (WTG) part, or on a quay wall, jetty, oil rig platform, and the like.

The invention may be used for offshore lifting any object in a safe manner. Examples of such objects comprise but are not limited to turbine components, such as tower (parts), full towers, split tower sections (for instance two or three sections), nacelles (optionally provided with a rotor), blades (or a blade rack provided with a single blade or containing multiple blades), and a pre-assembled combination of the above in any form; wind turbine foundation components such as monopiles, transition pieces, anode cages (or an anode cage tower containing multiple anode cages), and all types of jacket foundations; and general items, such as but not limited to supply containers of any kind, offshore wind turbine (foundation) installation equipment, and spare vessel and equipment parts. The weight of the objects is immaterial to the invention but objects weighing 350 tons (a split tower section for instance) and 1600 tons (a monopile or jacket foundation for instance) and more, may be lifted with the support of the invented device.

The lifting point or points may be located everywhere on the object to be lifted, or may comprise a lifting surface, such as when a suspension frame or sling is used for lifting. The lifting point preferably comprises an upper part or end of the object.

Accurate positioning of the object to be lifted may be enhanced by an embodiment of the invented assembly in which the floating vessel comprises a dynamic positioning (DP) or mooring system. Such systems, known per se, allow keeping a vessel in a relatively constant position relative to an underwater bottom and/or in a relatively constant position relative to the lifting device, at least within some tolerances, without using spud poles, as in a jack-up platform for instance. The mooring system of the jack-up platform may comprise a number of mooring lines, provided at one end with a suitable means for connecting to the floating vessel, and at another end provided around a winch or other suitable taking in/paying out means. The number of mooring lines may be chosen conveniently between one and any number, for instance 2, 3, 4, 5, 6, 7, 8, 9, 10, or even more. An aim of the mooring system is to keep the actual position of the floating vessel relative to the underwater bottom or to the lifting device used for lifting within a safe distance from the position of the lifting device, allowing for safe lifting operations.

The device is particularly useful for lifting a foundation element of a wind turbine and, optionally, providing the foundation element into an underwater bottom from a deck of the moored floating vessel, according to methods as elucidated in the appended claims.

It is expressly stated that the embodiments of the invention described in the present patent application can be combined in any possible combination of these embodiments, and that each embodiment can individually form the subject-matter of a divisional patent application.

BRIEF DESCRIPTION OF THE FIGURES

The invention will now be elucidated with reference to the following figures, without however being limited thereto. In the figures.

DESCRIPTION OF EXEMPLARY EMBODIMENTS

Figure 1:
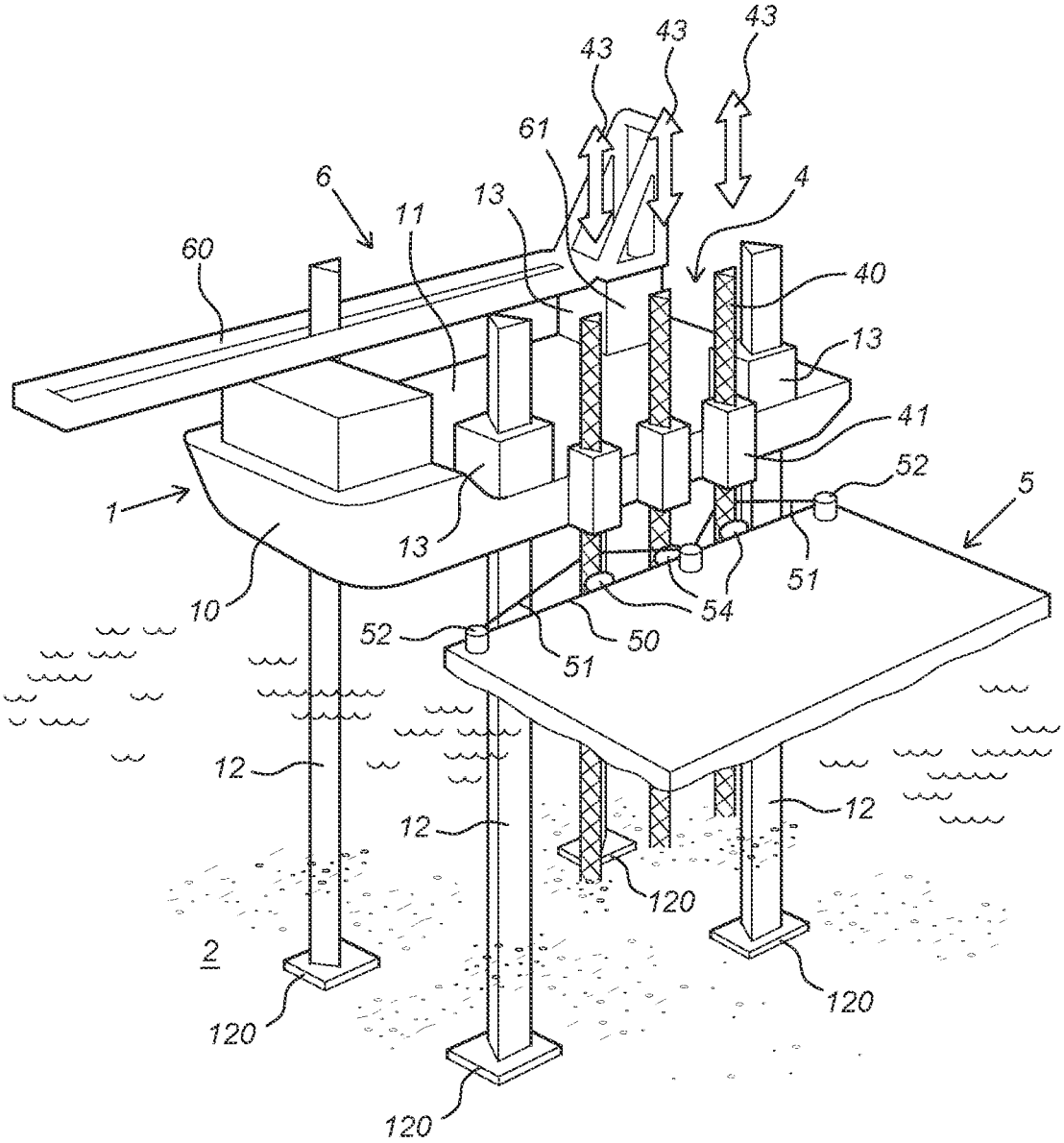
FIG. 1 represents a schematic perspective view of a jack-up platform against which a floating vessel is moored in accordance with an embodiment of the invention.
Figure 2:
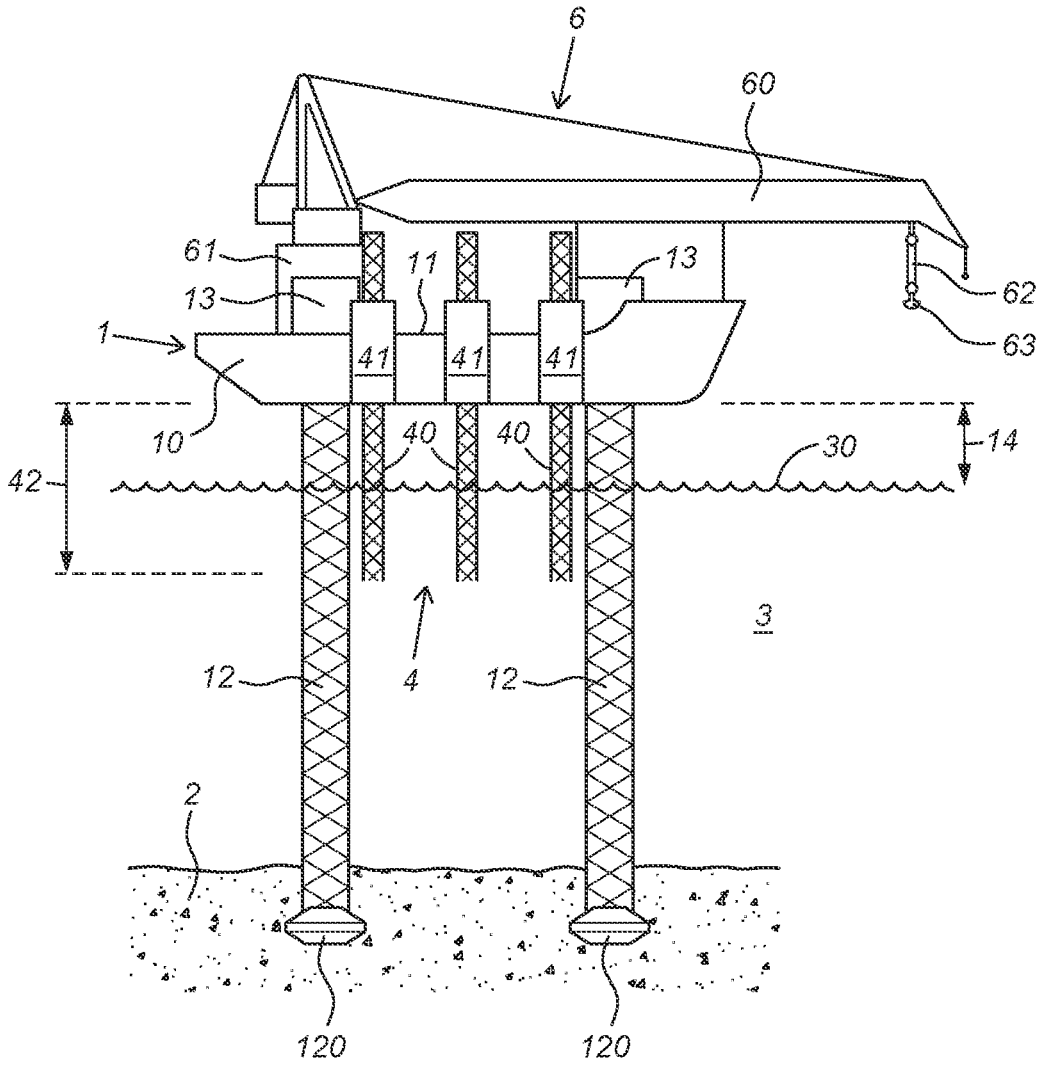
FIG. 2 represents a schematic side view of the jack-up platform shown in the embodiment of FIG. 1.

With reference to FIGS. 1 and 2, a jack-up vessel or platform 1 in accordance with an embodiment of the invention, comprises a hull 10, a horizontal working deck 11 and a number of vertically extending legs 12 that connect to the working deck 11 through a jacking system 13, provided on corners of the hull 10. Each jacking system 13 is configured to move a leg 12 between a higher position, in which the leg 12 is free from an underwater bottom 2 and the hull 10 is floating on the water 3, and a lower position, shown in FIGS. 1 and 2. In the lower position of the legs 12, each leg 12 takes support on or in the underwater bottom 2 and the hull 10 is jacked out of the water over some distance 14 between a bottom of the hull 10 and the water surface 30. The legs 12 shown are of lattice type and at a bottom side provided with shoes or spud cans 120. The legs 12 may be embodied differently however, and may for instance comprise solid legs, optionally without shoes 120.

The jack-up platform 1 further comprises a mooring system 4. The mooring system 4 is configured to moor a floating vessel 5 at a mooring side 15 of the jack-up platform 1. In the shown embodiment, the mooring system 4 comprises three elongated support means in the form of lattice or other leader legs of triangular or other cross-section shape 40, and guiding means, which could come in the form of a jacking system 41, rigidly connected to the hull 10 of the jack-up platform 1 along a line extending parallel to the mooring side 15 of the hull 10. The connection may be welded, or may be embodied by any other suitable way of connection. Each guiding means 41 in operation holds an elongated leader leg 40 and is able to move the leader leg 40 up and down between different vertical positions, as schematically shown by the arrows 43 in FIG. 1. Each guiding means 41 is configured to rigidly hold an elongated leader leg 40 in a support position, shown in FIGS. 1 and 2, in which each elongated leader leg 40 (or at least some of these legs 40) is within reach of a hull part 50 of the floating vessel 5 to be supported when the hull 10 is jacked out of the water 3 over the distance 14 and the jack-up platform 1 rests on its legs 12. In the support position, each leader leg 40 is jacked down sufficiently to be able to support said hull part 50 of the floating vessel 5, moored against the jack-up platform 1. In the support position, each leader leg 40 thereto extends into the water 3 over a distance 42 (see FIG. 2) that reaches sufficiently deep to enable supporting the hull part 50 of the floating vessel 5 in mooring position. An outer end of each leader leg 40 is hanging freely in the water 3.

Figure 3A:
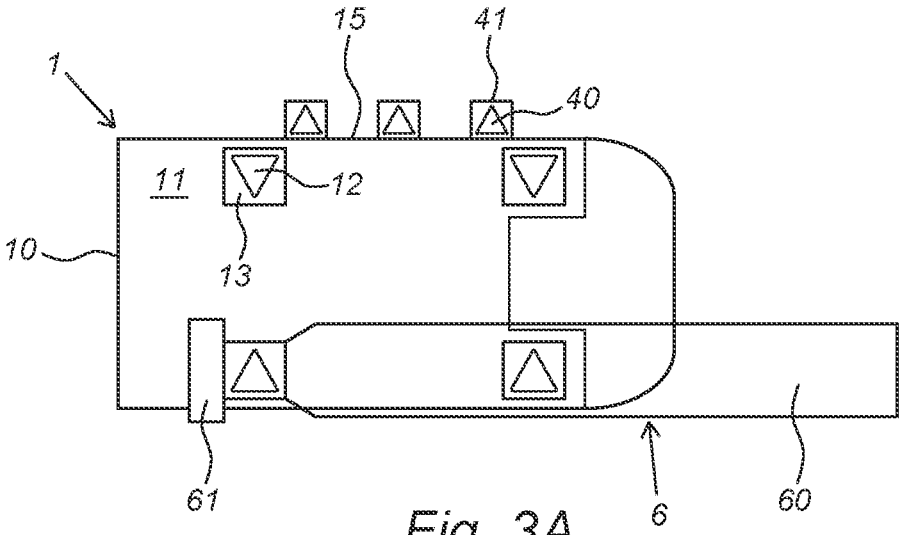
FIG. 3A shows a schematic top view of the jack-up platform shown in the embodiment of FIG. 1.
Figure 3B:
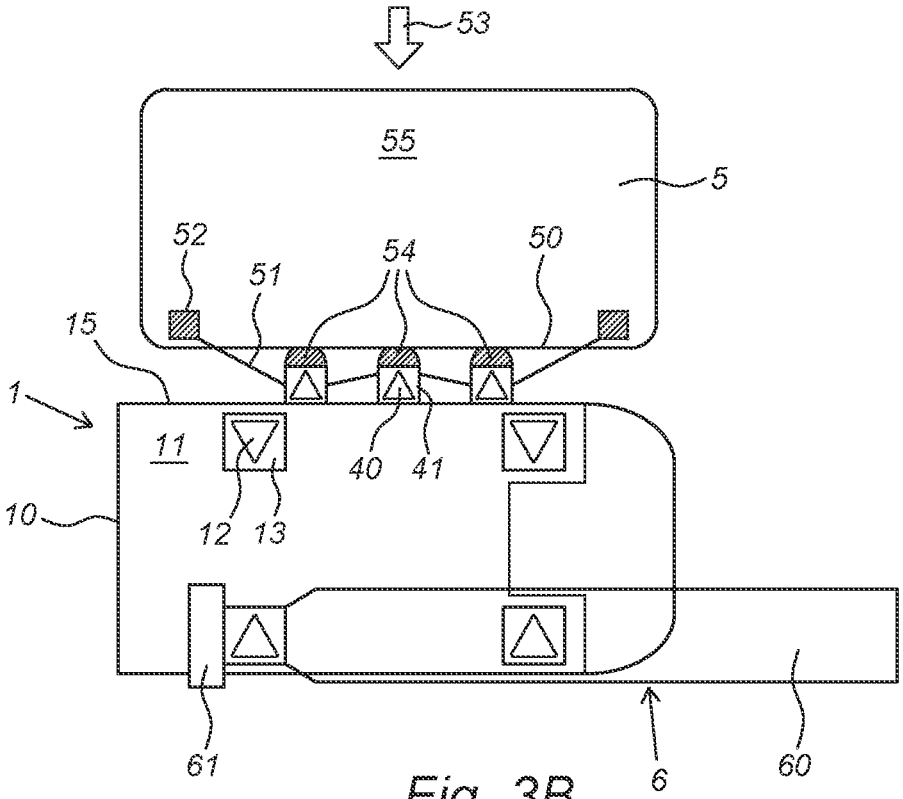
FIG. 3B shows a schematic top view of the jack-up platform shown in the embodiment of FIG. 1 against which a floating vessel is moored.

In the mooring position of the floating vessel 5, the connection between the floating vessel or barge 5 and the leader legs 40 may be accomplished by using conventional mooring lines 51 and winches 52, provided on the floating vessel 5. The winches could also be provided on the jack-up vessel 1, or be integrated in one or more of the leader legs 40. The winches 52 are configured to take in a length of mooring line 51, thereby bringing the vessel 5 closer to the leader legs 40 in the direction of the arrow 53 of FIG. 3B, until the hull part 50 contacts the leader legs 40. Paying out a length of mooring line 51 may remove the floating vessel 5 from the mooring side 15 of the jack-up platform. To prevent peak loads on the leader legs 40 from occurring, shock dampers may be incorporated in between each leader leg 40 and the hull part 50 of the floating vessel 5, such as the fenders 54.

Figure 8A:
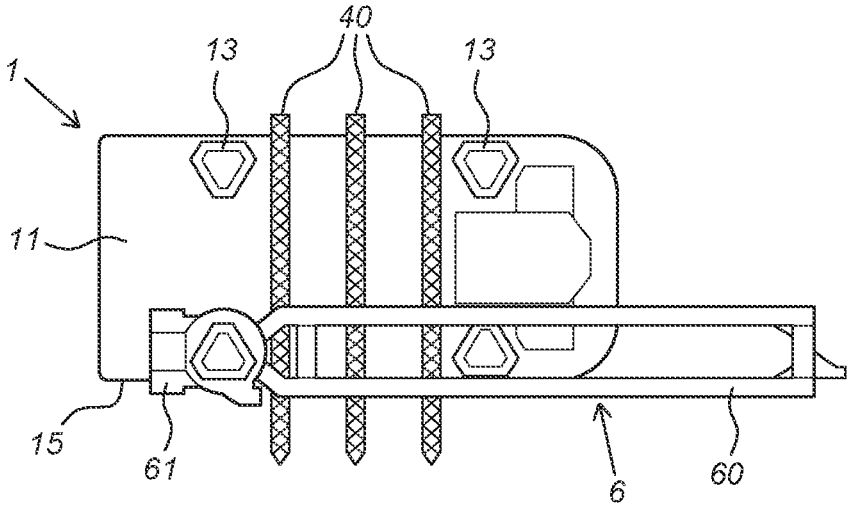
FIG. 8A to 8E schematically show a top view of method steps that include lifting the elongated support means with a lifting device from a resting position on the working deck of the jack-up platform and providing the elongated support means to the guiding means and into its support position in accordance with an embodiment of the invention.
Figure 9A:
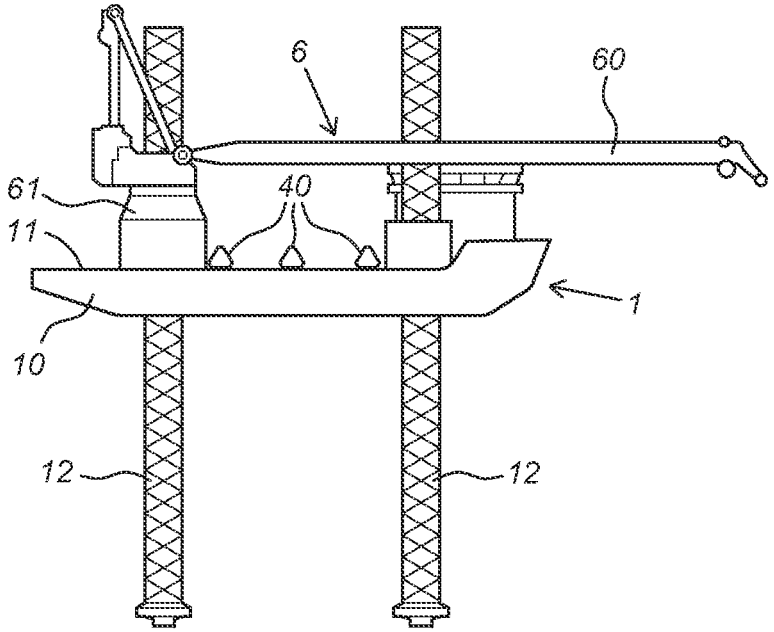
FIG. 9A to 9E schematically show a side view of the method steps shown in FIGS. 8A to 8E respectively.
Figure 8B:
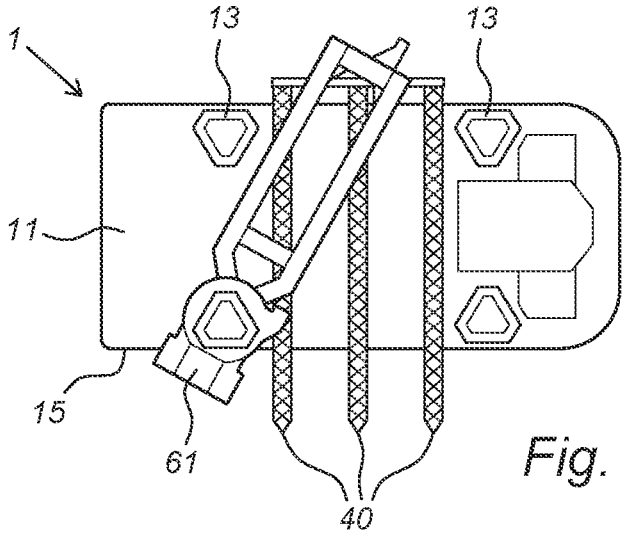
Figure 9B:
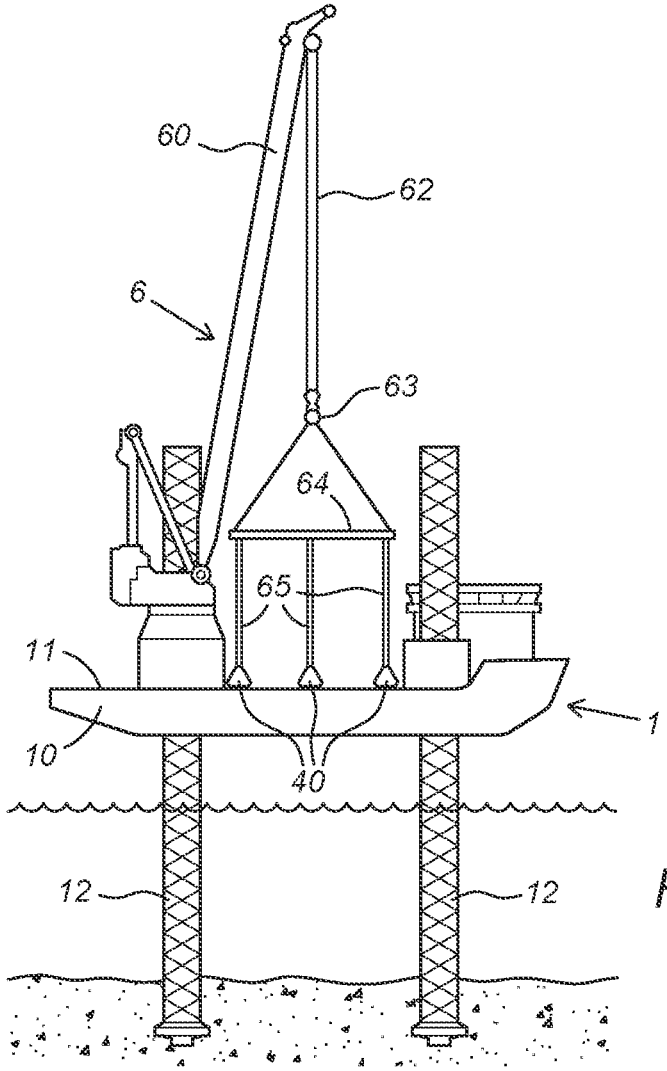
Figure 8C:
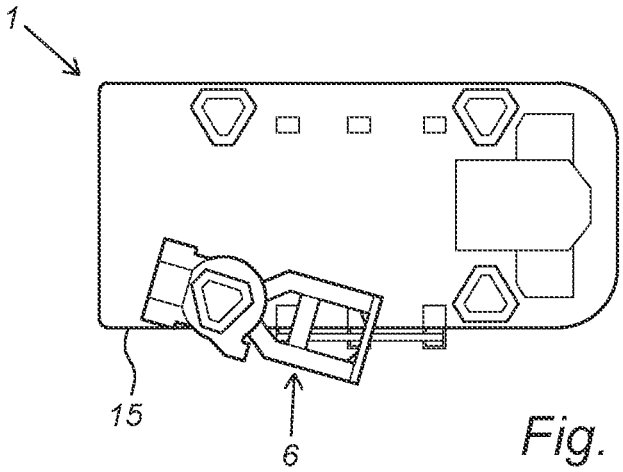
Figure 9C:
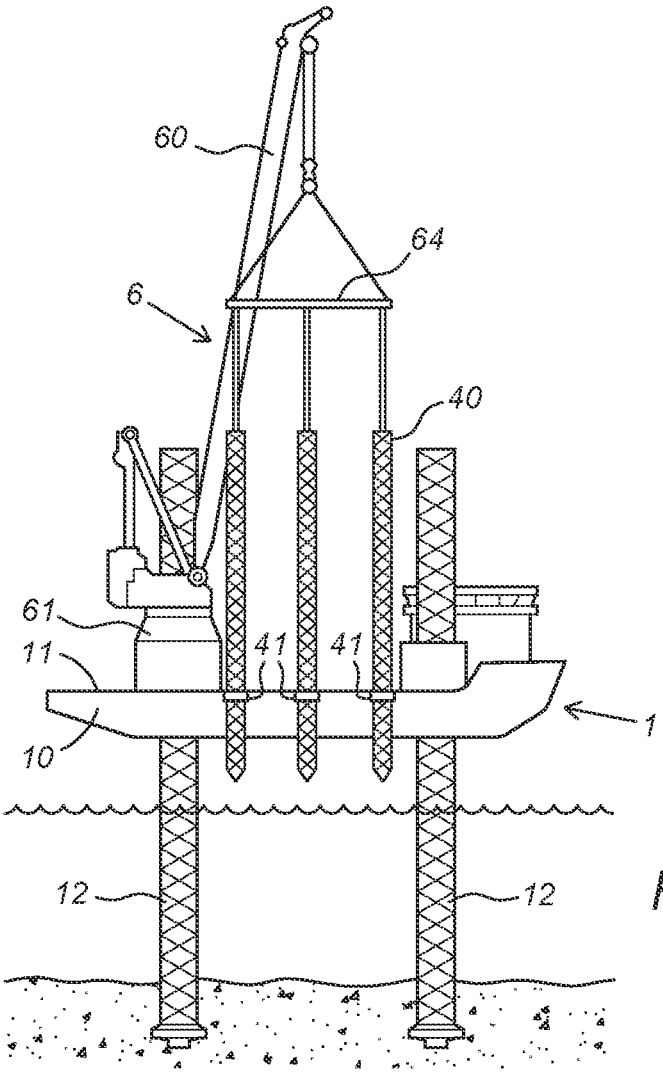
Figure 8D:
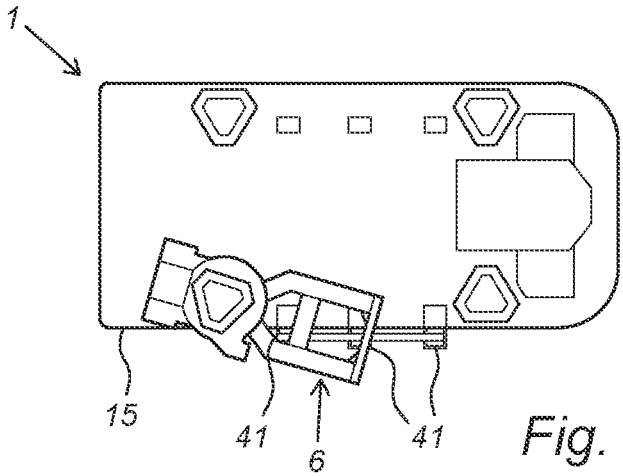
Figure 9D:
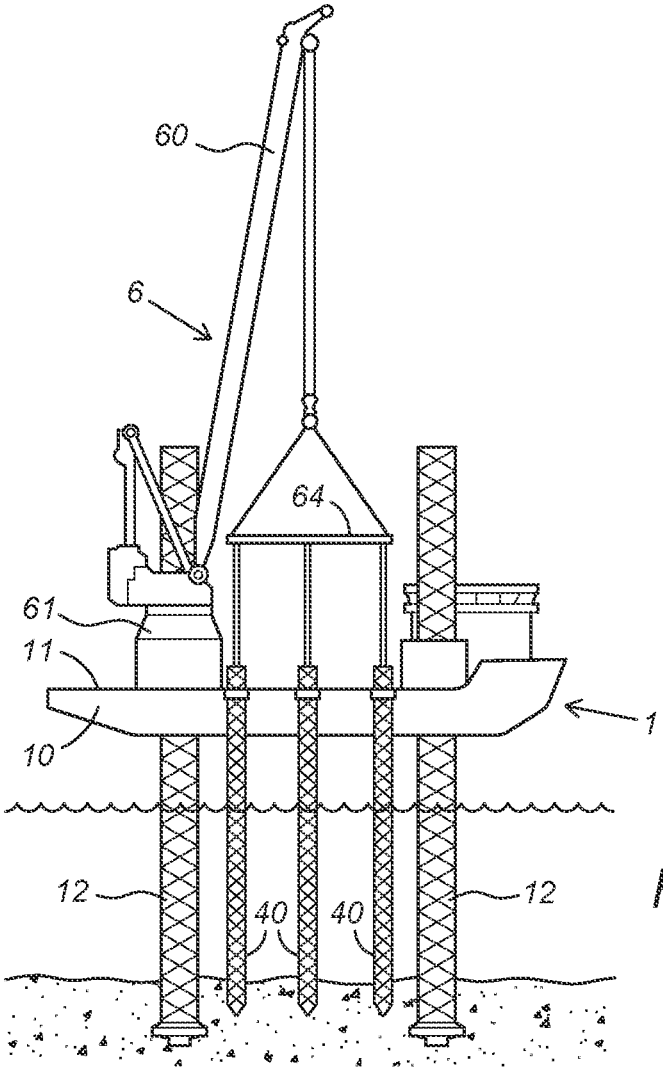
Figure 8E:
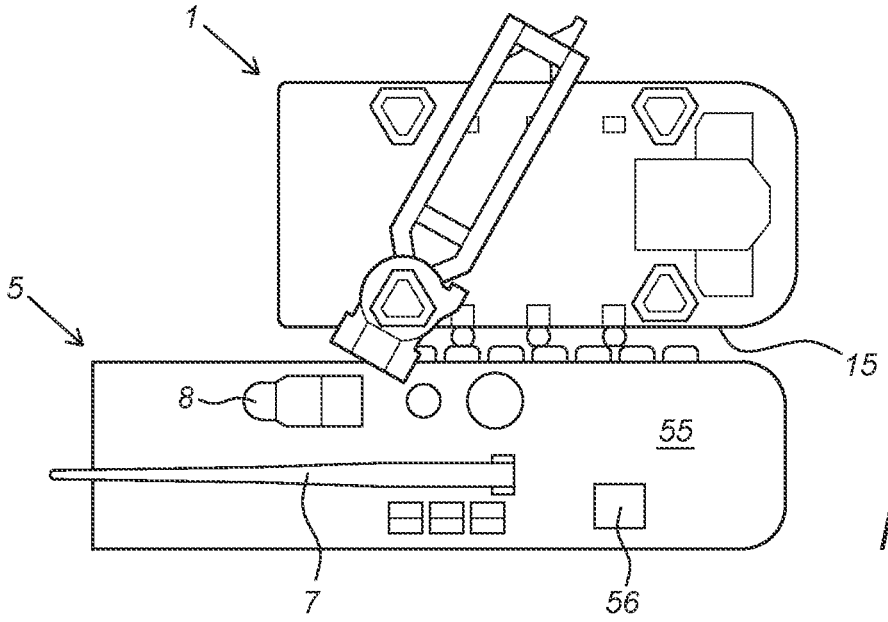
Figure 9E:
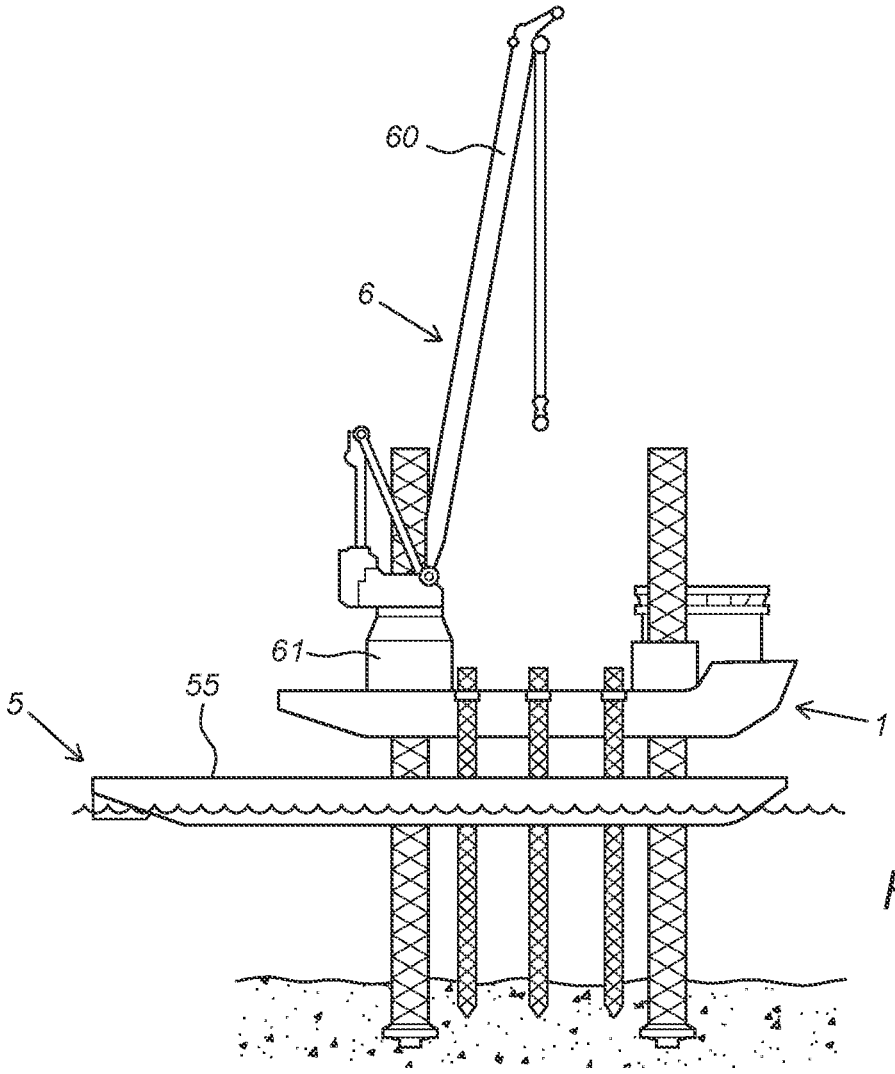

The jack-up platform 1 further comprises a lifting device 6, a boom 60 of which is pivotably provided around a lifting device base 61, supported on the working deck 11 of the jack-up platform 1. The lifting device 6 is further provided with hoisting cables 62 and, at a free outer end thereof, with a hoisting block 63 with hook, from which an object (not shown) may be suspended. In an embodiment, the lifting device 6 may also be used for lifting a number of leader legs 40 from a resting position on the working deck 11 and providing each leader leg 40 into its corresponding guiding means 41, and for lowering each leader leg 40 into its support position. Alternatively, the leader legs 40 and the guiding means 41 are pre-assembled and configured to be able to be up-ended overboard together, whereby the guiding means 41 are provided with a hinge point on the side of the hull 10. This embodiment is shown in FIGS. 8A to 8E, and 9A to 9E. As shown in FIGS. 8A and 8B, three leader legs 40 are provided in a rest position on the working deck 11 of the jack-up platform 1. This may also be the position of the leader legs 40 during transport to the offshore site of interest. In their rest position, the leader legs 40 may for instance be provided horizontally (as shown) in appropriate storage means. As shown in FIGS. 8B and 9B, the lifting device 6 is luffed up and a hoisting frame 64 connected to the hoisting block 63 is brought to the leader legs 40 which are then attached to three cables 65 of the hoisting frame 64 at a port side of the jack-up platform 1. Please note that the hoisting frame 64 and the mooring system may also be provided at starboard side of the jack-up platform 1. Referring to FIGS. 8C and 9C, the lifting device 6 up-ends the three leader legs 40 suspended from the frame 64 and brings them to the starboard side of the jack-up platform, which starboard side, in the embodiment shown, corresponds with the mooring side 15 of the jack-up platform 1. The leader legs 40 are up-ended together with their respective guiding means 41, and lowered further into their support positions, as shown in FIGS. 8D and 9D. Each leader leg 40 is clamped by its corresponding guiding means 41, and firmly held in this support position. As shown in FIGS. 8E and 9E, a floating vessel 5 may then be moored against the elongated leader legs 40 with appropriate auxiliary equipment such as winches, mooring lines and fenders, as already described above. As shown in FIG. 8E, the floating vessel 5 may be provided with objects to be lifted, which in the embodiment shown comprise wind turbine blades 7 and a nacelle 8, carried on deck 55 of the vessel 5.

In another embodiment, the guiding means 41 are provided with an optional hinge point on the side of the hull 10, and the leader legs 40 positioned on deck separately from the guiding means 41. The leader legs 40 may then be taken up by the lifting device 6 and inserted in the guiding means 41, and brought overboard.

Figure 4:
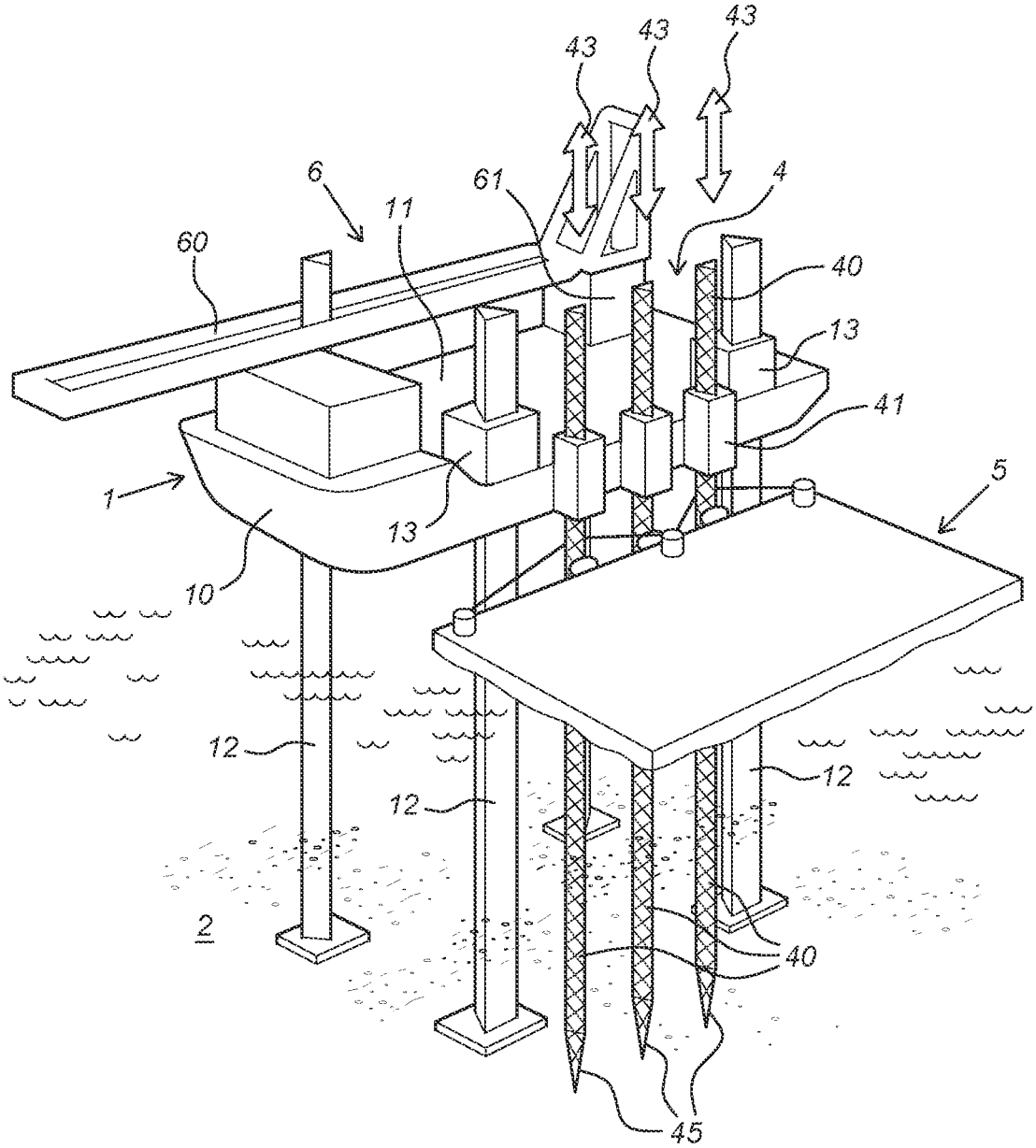
FIG. 4 represents a schematic perspective view of a jack-up platform against which a floating vessel is moored in accordance with yet another embodiment of the invention.
Figure 5:
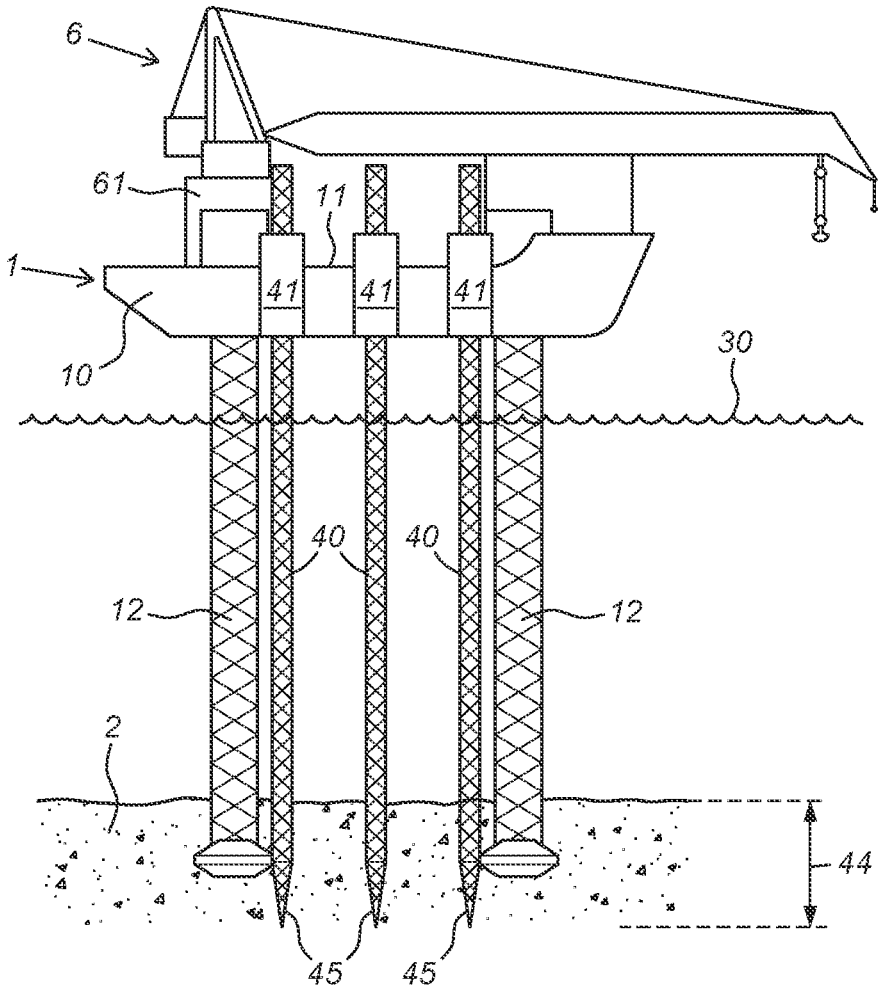
FIG. 5 represents a schematic side view of the jack-up platform shown in the embodiment of FIG. 4.

FIGS. 4 and 5 show yet another embodiment of the invention. Here, a jack-up platform is provided having the same features as the embodiment shown in FIGS. 1 and 2, but having the three leader legs 40, in the support position, extend into the underwater bottom 2 over some distance 44 to take support in the underwater bottom 2. In this embodiment, forces exerted by the moored vessel 5 on the leader legs 40 are not only absorbed by the guiding means 41 and led into the hull 10 of the jack-up platform 1, but are also absorbed by their fixation into the underwater bottom 2. In order to facilitate penetration of the leader legs 40 into the underwater bottom 2, the leader legs 40 may at a bottom side thereof be provided with pointed end parts 45.

Figure 6:
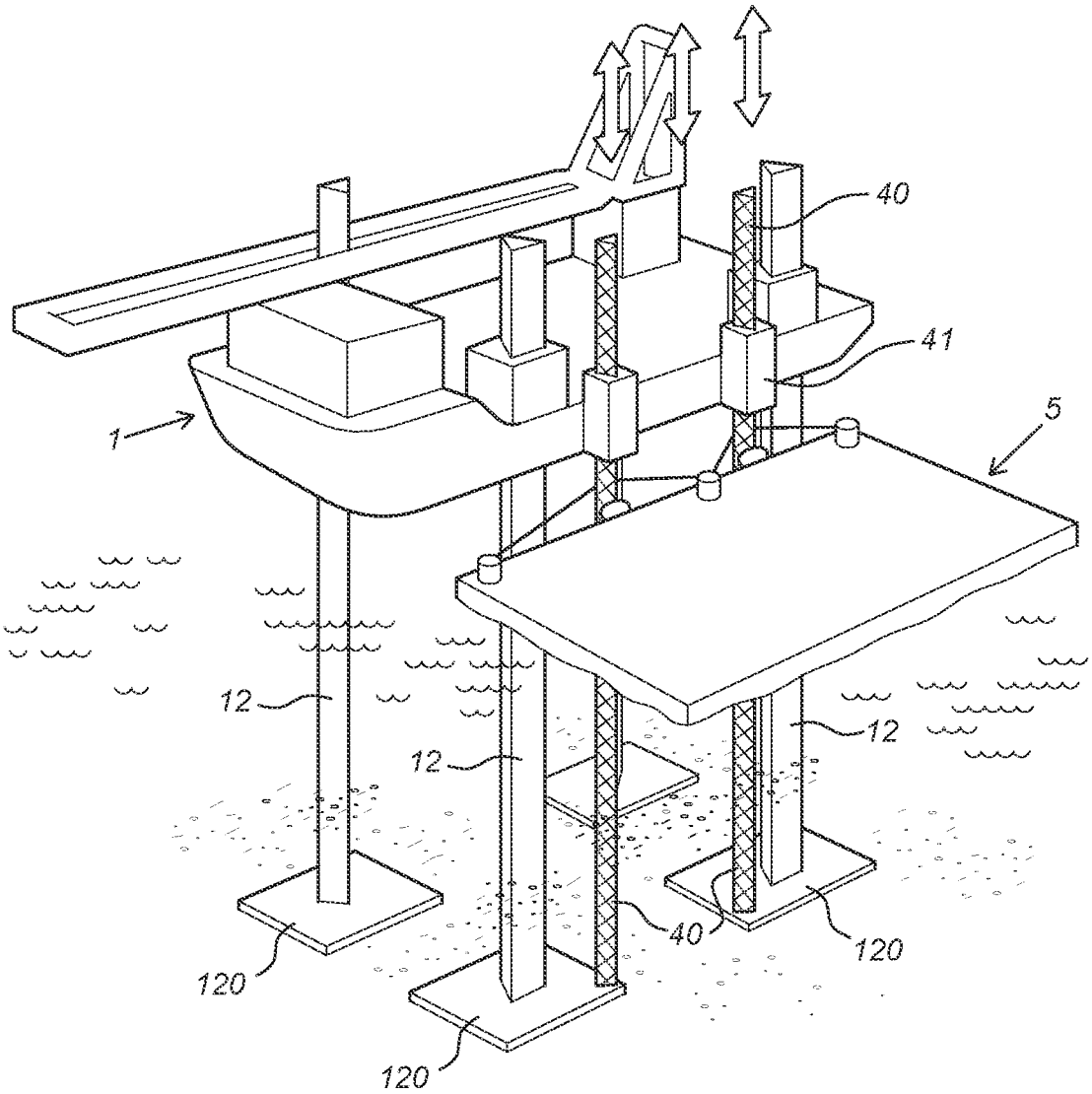
FIG. 6 represents a schematic perspective view of a jack-up platform against which a floating vessel is moored in accordance with yet another embodiment of the invention.
Figure 7:
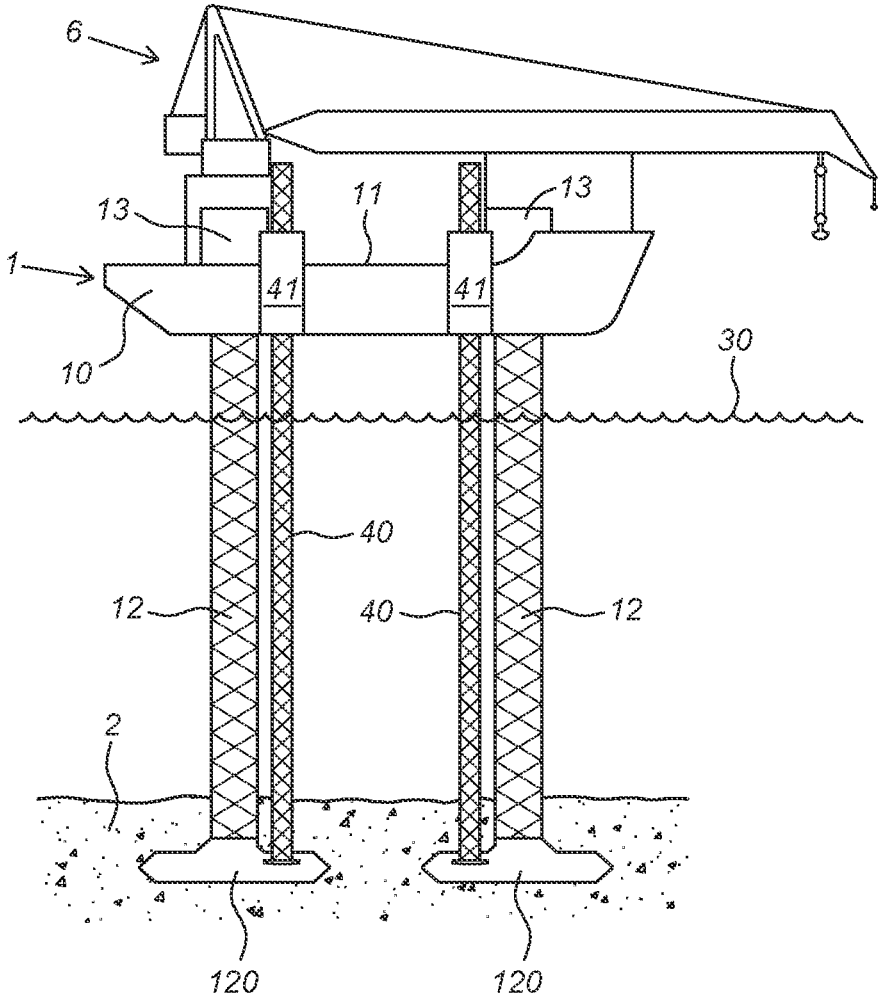
FIG. 7 represents a schematic side view of the jack-up platform shown in the embodiment of FIG. 6.

Yet another embodiment of the invention is shown in FIGS. 6 and 7. Here, a jack-up platform is provided having the same features as the embodiment shown in FIGS. 1 and 2, but having the three leader legs 40, in the support position, extend into an enlarged foot section or shoe 120 of each vertical leg 12 of the jack-up vessel or platform 1. In the support position of the leader legs 40, each leader leg 40 at the mooring side 15 of the jack-up vessel or platform 1 then takes support in its corresponding spud leg shoe 120, provided on the mooring side 15. In this embodiment, forces exerted by the moored vessel 5 on the leader legs 40 are not only absorbed by the guiding means 41 and led into the hull 10 of the jack-up platform 1, but are also absorbed by their fixation into the shoes 120. The connection between a lower part of the leader legs 4 and the shoes 120 may be permanent, for instance by welding, or may be detachable, for instance by providing the shoes 120 with holes into which a lower part of each leader leg 40 may be received and, optionally, secured. This embodiment has the additional advantage of not having to rely on the, sometimes uncertain or variable, properties and cohesion of the underwater bottom 2.

Figure 10:
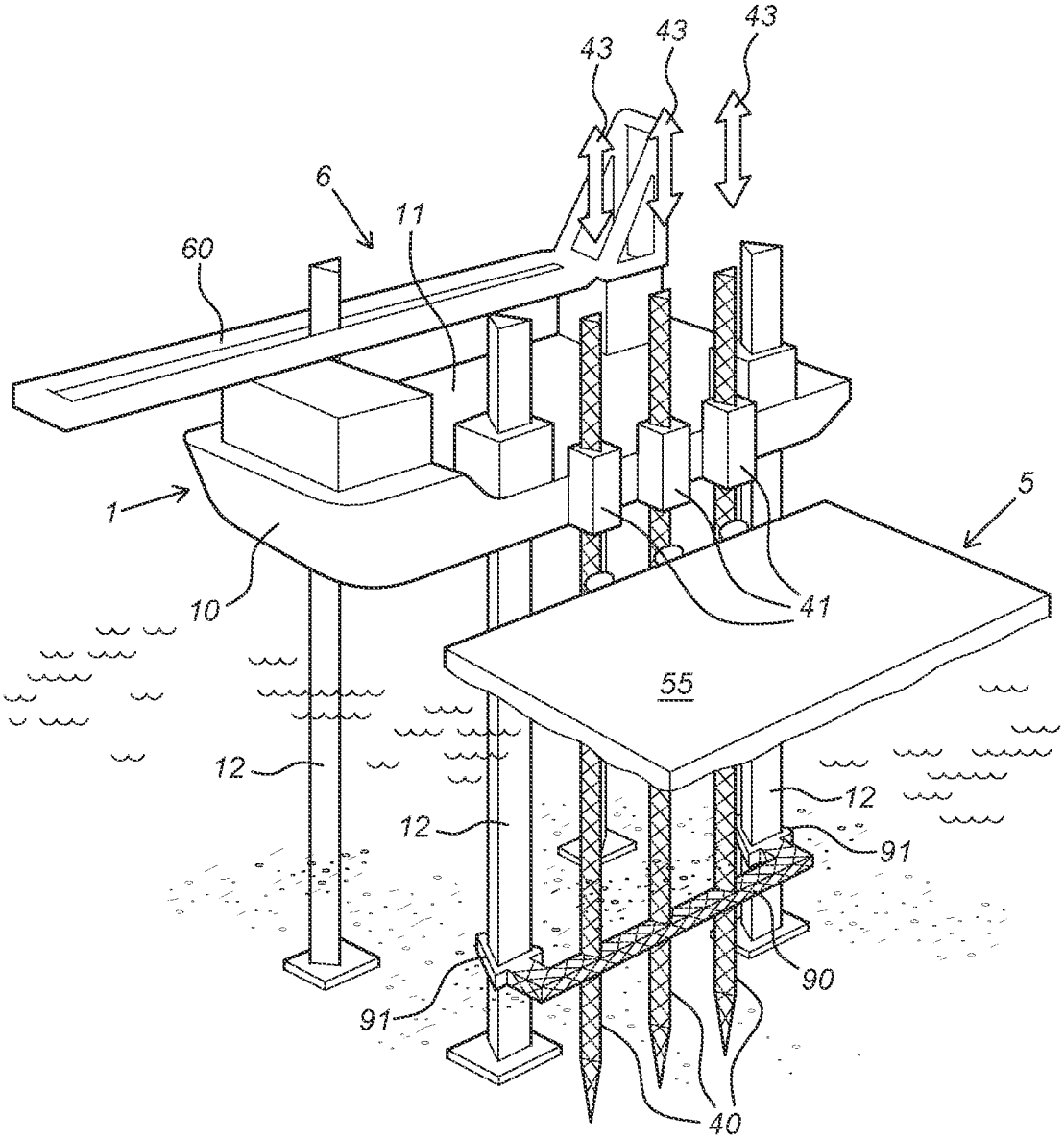
FIG. 10 represents a schematic perspective view of a jack-up platform against which a floating vessel is moored in accordance with yet another embodiment of the invention; and finally

FIG. 10 yet shows another embodiment of the jack-up platform 1 and mooring system 4. In the embodiment shown, the jack-up platform 1 further comprises a connecting structure 9, comprising a steel brace or beam 90, that is configured to connect the leader legs 40 with a vertical spud leg 12 of the jack-up platform 1. The connecting structure 9 connects with each spud leg 12 through guides 91 that are provided on each end of the brace or beam 90. The guides 91 allow the leader legs 40 to be moved between different vertical positions, relative to the spud legs 12 of the jack-up platform 1. In this embodiment, forces exerted by the moored vessel 5 on the leader legs 40 are not only absorbed by the guiding means 41 and led into the hull 10 of the jack-up platform 1, but are also absorbed by the spud legs 12 on the mooring side 15, or alternatively, on spud legs provided on another side than the mooring side 15. The forces are transmitted to said spud legs 12 through the connecting structure 9. The connecting structure 9 shown had one brace 90 but may also comprise a plurality of braces, provided on different heights (vertical levels).

Figure 11:
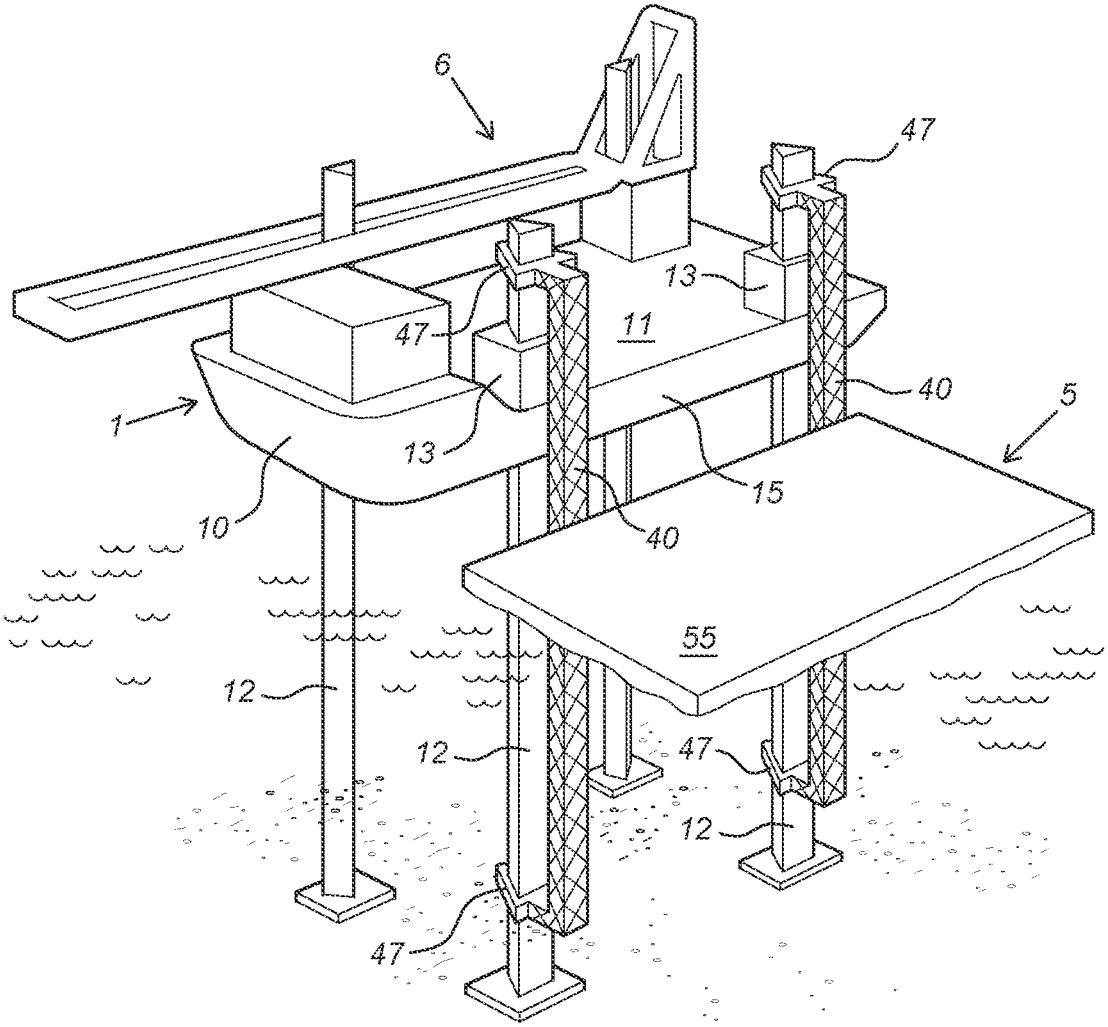
FIG. 11 represents a schematic perspective view of a jack-up platform against which a floating vessel is moored in accordance with yet another embodiment of the invention.

As shown in FIG. 11, another embodiment comprises a jack-up platform 1 wherein the guiding means actually comprise the vertical spud legs 12 provided at the mooring side 15 of the jack-up platform 1, and its corresponding jacking system 13. The elongated leader legs 40 in this embodiment extend vertically along the mooring side spud legs 12 in the support position. They are attached to the mooring side spud legs 12 through leader leg guides 47 that are fixedly provided on each end of each leader leg 40. An upper and a lower leader leg gliding guide 47 of a leader leg 40 are provided around a spud leg 12 such that they allow the leader leg 40 to be moved between different vertical positions, relative to the spud leg 12 of the jack-up platform 1. At least an upper or a lower leader leg guide 47 (or both) may be fixed onto the leg 12 in the support position of the leader leg 40. In this embodiment, forces exerted by the moored vessel 5 on the leader legs 40 are not absorbed by the guiding means 41 and led into the hull 10 of the jack-up platform 1. Instead, they are absorbed by the jacking system 13 of the spud legs 12 at the mooring side 15. This may be a practical solution, as long as the expected mooring forces do not increase to levels such that the integrity of the spud legs 12 system may be compromised.

The invented jack-up platform 1 may be used advantageously for mooring a floating vessel 5 against it. An assembly of the invented jack-up platform 1 and such a floating vessel 5 is for instance shown in FIGS. 1, 3B, 4, 6, 8E, 9E, 10 and 11, and represents a relatively stable assembly, due to the stabilizing effect of the spud legs 12 and the mooring system 4 on the assembly (1, 5). The floating vessel 5 may comprise a dynamic positioning (DP) system 56, as schematically shown in FIG. 8E.

The assembly (1, 5) of a floating vessel 5 moored against a jack-up platform 1 under the intervention of the mooring system 4, allows to safely lifting an object, such as a wind turbine blade 7 or a nacelle 8, from the deck 55 of the moored floating vessel 5. Other systems may in addition be used to safely lift-off an object. Another benefit of the invented mooring system is that the floating vessel is kept positioned in the horizontal direction as close as possible to the jack-up platform 1 and its lifting device to maximize the lifting device's efficiency. Having the invented mooring system on the lifting device vessel means it can be used with all different kinds of floating vessels without being forced to adapt the latter. The lifted object may be provided on the working deck 11 of the jack-up platform 1 or on another substrate, such as a foundation element of a wind turbine (not shown) provided in the underwater bottom 2. It is without saying that other objects may be lifted such as a monopile, a transition piece, wind turbine components and other objects that are used in installing wind turbines offshore.

The invention is not limited to the above described embodiments and also comprises modifications thereof, to the extent that these fall within the scope of the claims appended below.

The invention claimed is:

1. A jack-up platform comprising a hull, a horizontal working deck and a number of vertical legs that connect to the working deck through jacking systems, each jacking system being configured to move a leg between a lower position, in which the leg takes support on an underwater bottom and the hull is jacked out of the water, and a higher position, in which the leg is free from the underwater bottom and the hull is floating on the water, wherein the jack-up platform further comprises a lifting device configured for lifting objects from a floating vessel, and a mooring system configured to moor the floating vessel at a mooring side of the jack-up platform, the mooring system comprising at least two elongated support means for supporting a hull part of the floating vessel, and for connecting the floating vessel to the jack-up platform, and guiding means connected to the hull of the jack-up platform at the mooring side, and configured to rigidly hold the elongated support means in a support position, in which the elongated support means are within reach of the hull part of the floating vessel to be supported when the hull is jacked out of the water and the jack-up platform rests on its legs, wherein the mooring system is configured to stabilize the floating vessel in at least a horizontal plane relative to the jack-up platform and the lifting device by limiting horizontal movements.

2. Jack-up platform according to claim 1, wherein the lifting device is configured to lift the elongated support means from a resting position on the working deck and provide the elongated support means to the guiding means and into its support position.

3. Jack-up platform according to claim 1, wherein the guiding means are hingedly connected to the hull of the jack-up platform, and the lifting device is configured to up-end the elongated support means from a resting position on the working deck around the guiding means and into its support position.

4. Jack-up platform according to claim 1, wherein the guiding means hold the elongated support means.

5. Jack-up platform according to claim 1, wherein the guiding means are configured to hold the elongated support means and move the same between different vertical positions.

6. Jack-up platform according to claim 1, wherein elongated support means, in the support position, takes support on or in the underwater bottom.

7. Jack-up platform according to claim 1, wherein a vertical leg of the jack-up platform comprises a transversely enlarged foot support and an elongated support means, in the support position, takes support on or in the transversely enlarged foot support.

8. Jack-up platform according to claim 1 wherein the guiding means comprise at least one vertical leg of the jack-up platform located at the mooring side.

9. Jack-up platform according to claim 1, further comprising a connecting structure configured to connect an elongated support means with a vertical leg of the jack-up platform, while allowing the elongated support means to be moved between different vertical positions.

10. Jack-up platform according to claim 1, wherein the elongated support means extends vertically in the support position.

11. Jack-up platform according to claim 1, wherein the number of elongated support means is at least three.

12. Assembly of a jack-up platform in accordance with claim 1 and a floating vessel, moored against it with the mooring system.

13. Assembly according to claim 12, wherein the mooring system, the jack-up platform and/or the floating vessel comprises auxiliary equipment selected from among winches, mooring lines and fenders.

14. Assembly according to claim 12, wherein the floating vessel comprises a dynamic positioning (DP) system.

15. Method for lifting an object from a floating vessel provided at a mooring side of a jack-up platform in accordance with claim 1, the method comprising the steps of:

moving the legs of the jack-up platform from a higher position, in which the legs are free from an underwater bottom and the hull is floating on the water, to a lower position, in which the legs take support on the underwater bottom and the hull is jacked out of the water;

providing elongated support means, configured for supporting a hull part of the floating vessel and connecting the floating vessel to the jack-up platform, in a support position of the elongated support means within reach of the hull part of the floating vessel to be supported by guiding means connected to the hull of the jack-up platform at the mooring side;

rigidly holding the elongated support means in the support position by the guiding means;

mooring the floating vessel against the elongated support means, and stabilizing the floating vessel in at least a horizontal plane relative to the jack-up platform and the lifting device by limiting horizontal movements; and lifting an object from a deck of the moored floating vessel and providing the object on the working deck of the jack-up platform or other substrate.

16. Method according to claim 15, wherein the object comprises a foundation element of a wind turbine.

17. Method according to claim 15, further comprising lowering the object onto and into the underwater bottom.

* * * * *